US006494764B1

(12) United States Patent
Tom

(10) Patent No.: US 6,494,764 B1
(45) Date of Patent: Dec. 17, 2002

(54) KITE HAVING NOISE EMITTING DEVICE

(75) Inventor: Randall L. Tom, Los Angeles, CA (US)

(73) Assignee: Marvel Enterprises, Inc., New York, NY (US)

( * ) Notice: Subject to any disclaimer, the term of this patent is extended or adjusted under 35 U.S.C. 154(b) by 0 days.

(21) Appl. No.: 09/567,384

(22) Filed: May 9, 2000

(51) Int. Cl.[7] ..... A63H 5/00

(52) U.S. Cl. ..... 446/397; 446/404; 446/213; 446/81; 244/153 R; 244/155 R

(58) Field of Search ..... 446/397, 404, 446/213, 81; 244/153 R, 155 R, 155 A, 154

(56) References Cited

U.S. PATENT DOCUMENTS 729,891 A * 6/1903 Pierce ..... 244/153 R
2,394,366 A * 2/1946 Chu et al. ..... 244/153 R
2,419,441 A * 4/1947 De Roda ..... 244/153 R
2,488,118 A * 11/1949 Comb et al. ..... 244/153 R
4,336,915 A * 6/1982 Stoecklin et al. ..... 244/153 R
4,634,085 A * 1/1987 Cuesta et al. ..... 244/153 R
4,752,051 A * 6/1988 Chang ..... 244/153 R
5,098,039 A * 3/1992 Linden, Jr. ..... 244/153 R

FOREIGN PATENT DOCUMENTS

GB 2063085 A * 6/1981 ..... A63H/5/00

* cited by examiner

*Primary Examiner*—Derris H. Banks
*Assistant Examiner*—Urszula M. Cegielnik
(74) *Attorney, Agent, or Firm*—Wolf, Block, Schorr and Solis-Cohen LLP

(57) ABSTRACT

A kite comprises a body attached to a rigid frame and a noise emitting device. The noise emitting device includes a resilient bow having a holder at each of its ends and a ribbon attached to each of the bow holders which vibrates in response to air flow. The bow holders comprise a holder member attached to the bow and a saddle which cooperates with the holder member for removably securing the ribbon to the bow.

12 Claims, 3 Drawing Sheets

KITE HAVING NOISE EMITTING DEVICE

BACKGROUND OF THE INVENTION

The invention relates to improvements in kites intended to be flown in the air and has a novel sound emitting device associated with the kite and positioned the same thereon that audible sound will be effected during the flying of the kite.

SUMMARY OF THE INVENTION

A kite comprises a body attached to a rigid frame and a noise emitting device. The noise emitting device includes a resilient bow having a holder at each of its ends and a ribbon attached to each of the bow holders which vibrates in response to air flow. The bow holders comprise a holder member attached to the bow and a saddle which cooperates with the holder member for removably securing the ribbon to the bow.

The kite may optionally include indicia formed on the body which simulates an insect.

The holder member may optionally comprise a slotted portion for receiving the saddle. The saddle may comprises a tang at each end for engaging the slotted portion of the holder.

In addition, the saddle may include a rounded shaft and a slot formed therein for receiving the ribbon. The saddle may further include a pair of frustoconical ends which bound the rounded shaft portion.

The noise emitting device may further optionally include a bracket which mounts the bow to the frame. The frame bracket may include a bore which receives the bow and spaces the bow a preselected distance from the body of the kite.

One object of the invention is the provision of a ribbon of suitable material and to support the same spaced distance above the top surface of the kite in a manner that will cause the ribbon to be vibrated and thus automatically buzz and thus emit sound that simulates the buzz of an insect in flight.

A further object of the invention is the connection of the ribbon to the ends of an elastic bow and to the transversely position the bow on the front top portion of the kite, whereby the resiliency of the bow will enable the ribbon to be easily vibrated by the velocity of the wind and to thus be more efficient in emitting sounds.

A further object of the invention is to connect the ribbon to the ends of the bow whereby the ribbon may be adjusted or replaced, when desired.

Other objects and advantages will be apparent during the course of the following description.

The above and other objects and features of the invention will be apparent to those skilled in the art to which the invention pertains from the following detailed description and the drawings.

BRIEF DESCRIPTION OF THE DRAWINGS

To the accomplishment of the above and related objects, this invention may be embodied in the form illustrated in the accompanying drawings, attention being called to the fact, however, that the drawings are illustrative only, and that changes may be made in the specific instruction illustrated and described within the scope of the appended claims.

DETAILED DESCRIPTION OF THE PREFERRED EMBODIMENT

Figure 1:
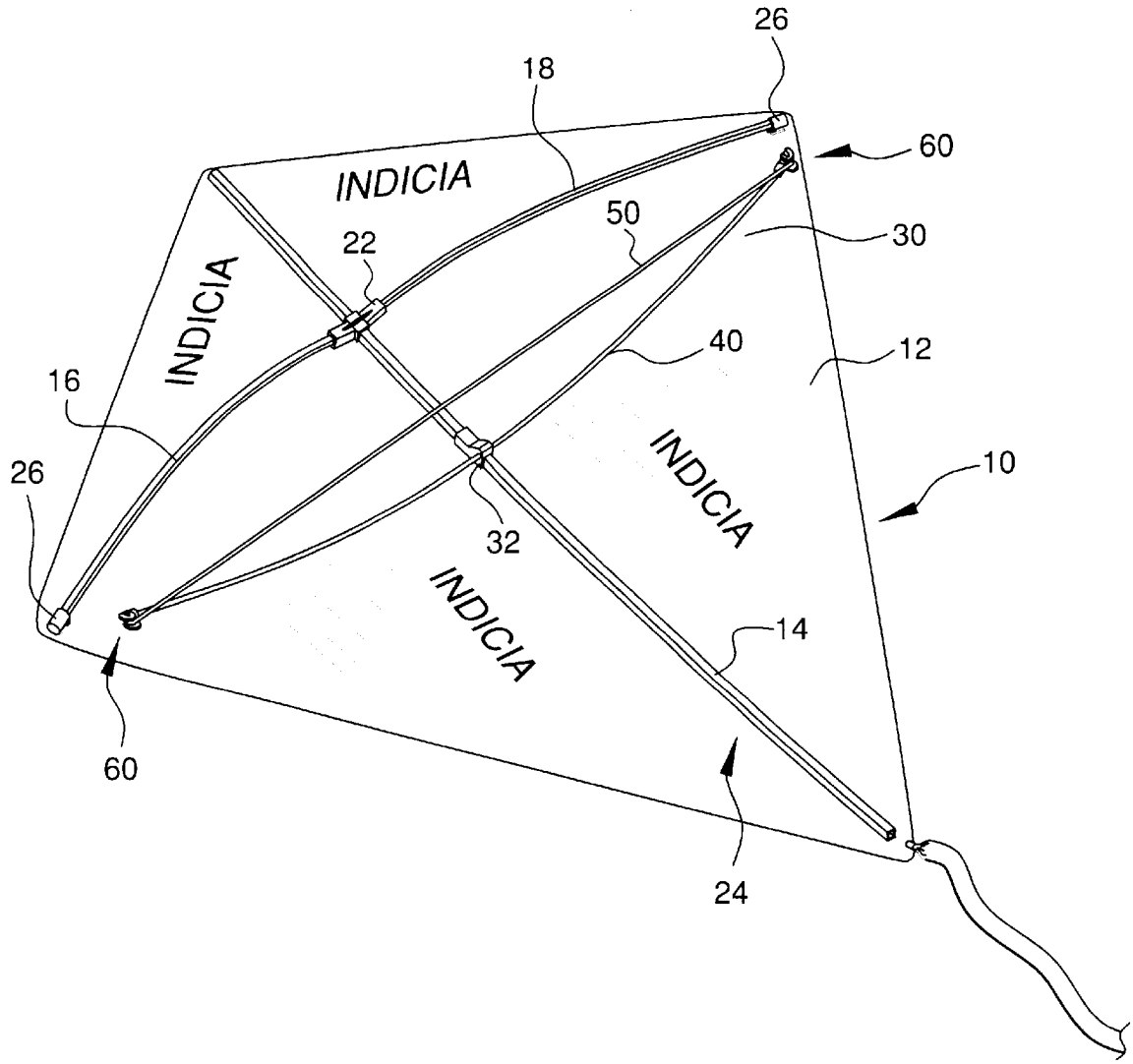
FIG. 1 is an isometric view of the kite in accordance with the preferred embodiment of the present invention.

In the following detailed description and the drawings, like reference characters indicate like parts.

In FIGS. 1–4, there is shown a kite 10 constructed in accordance with an embodiment of this invention. The kite 10 includes a body 12 of a sheet material secured a keel stick 14 and wing sticks 16 and 18. The sheet material is preferably fabricated from a lightweight plastic film or thin sheet and may include indicia 20 which simulates an insect. The keel and wing sticks are also preferably fabricated from a lightweight plastic material.

A bracket 22 is mounted on the keel stick 14 for receiving the wing sticks 16 and 18 and for holding them transversely of the keel stick to form a T-shaped frame 24.

The body 12 is attached to the T-shaped frame 24 via any suitable means, such as adhesive. The end portions of the wing sticks 16 and 18 are held in position on the body 12 and by holding 26 which are hooked preferably thereto.

A noise emitting device 30 is also mounted on the keel stick 14. The noise emitting device 30 includes a channel bracket 32 for attaching the noise emitting device 30 to the keel stick 14.

Figure 2:
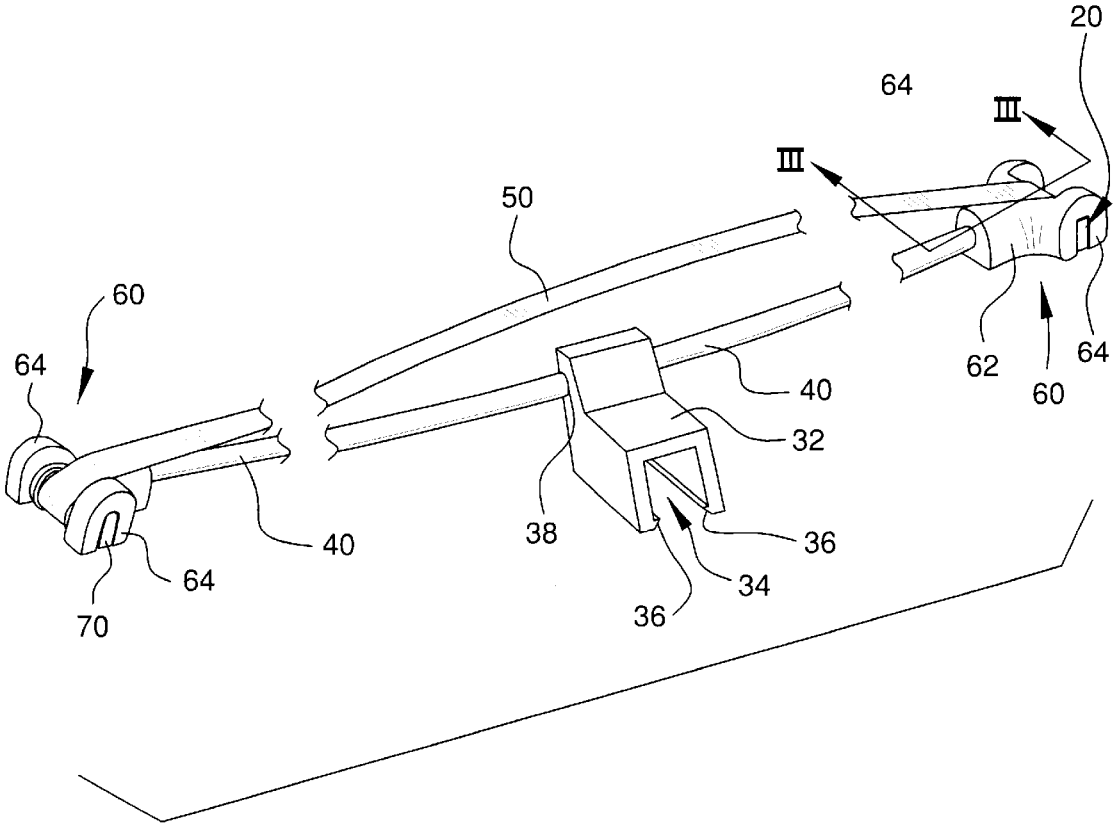
FIG. 2 is an expanded view of the noise emitting device of the kite shown in FIG. 1.

As best seen in FIG. 2, the channel bracket 32 includes having a rectangular U-shaped groove 34 which can be slipped on the correspondingly shaped rectangular keel stick. The channel bracket 32 includes a pair of inclined end walls 36 for removably mounting the channel bracket 32 onto the keel stick 14.

A bore 38 is formed in the bracket 32 for receiving an elastic bow member 40 and spacing same from the body 12 of the kite. The bow 40 is secured at its center in the bore 38 in the bracket 32. The ends of the resilient bow 40 are held together by a cord or other flexible ribbon 50. The ribbon is preferably fabricated from a mylar material. The ribbon ends are removably attached to the bow member 40 by means of a holder 60.

The holder 60 comprises a T-shaped clevis 62 and a seat 70 (best seen in FIG. 4) The clevis 62 has a bore which attaches the clevis 62 to the elastic bow member 40 and a pair of U-shaped-slotted ends 64 for holding the seat or saddle 70. The saddle 70 comprises a round shaft section 72 interposed between two frustoconical flanges 74 and a pair of tangs 76 at either end which fit into the slots of the U-shaped portion 64 of the T-shaped clevis 62. A longitudinal slot 78 is formed in the shaft portion of the saddle 70. The frustoconical flanges 74 are spaced so that the ribbon 50 fits there between to prevent lateral movement on the shaft 72.

Figure 3:
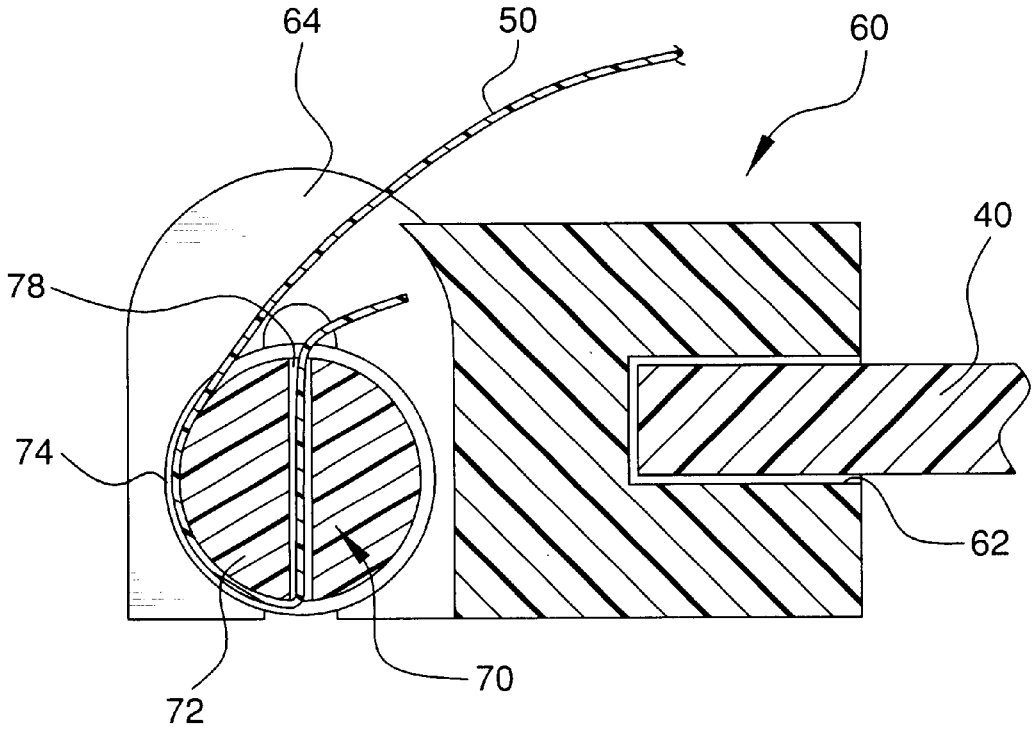
FIG. 3 is a cross-sectional view taken along line III—III.
Figure 4:
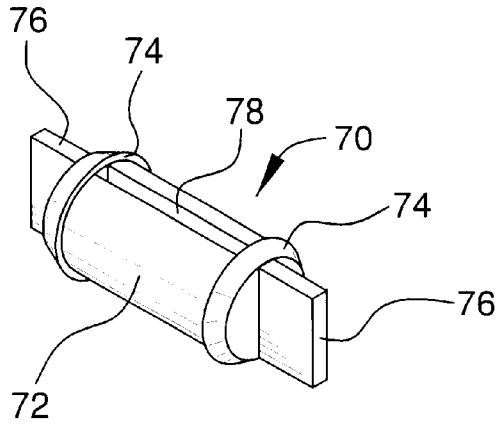
FIG. 4 is an isometric view of the saddle of the kite shown in FIG. 1.

The ribbon 50 is attached to the,elastic bow 40 in the following manner. As best seen in FIG. 3, one end of the ribbon 50 is passed through the slot 78 in the saddle 70 and the saddle 70 is rotated so that the ribbon 50 wraps around the axial face of the,shaft 72 between the frustoconical flanges 74 to secure the ribbon 50 to the saddle 70. The saddle 70 is then inserted into the holder 60 so that the tangs 76 of the saddle 70 are inserted in the slots 64 of the holder 60 to secure the saddle 70 thereto in a non-rotatable state. The saddle 70 will be positioned such that the ribbon 50 is wrapped around the outermost portion of the shaft and around the top of the shaft 72 to the saddle 70 on the opposite side of the bow 40.

During flight, the mylar ribbon 50 is subjected to violent vibrations caused by the kite 10 flying through the air which emits a buzzing-like sound to simulate the buzzing of an insect in flight.

In view of the foregoing description of the preferred embodiment of the invention, those skilled in the art will recognize that the principles of the invention can be applied in various ways. The kite illustrated in the drawings described above is subject to structural modifications without departing from the spirit or the scope of the appended claims. Although the invention has been illustrated and described in connection with a single specific embodiment, it is to be understood that the inventive concept is not limited to the specific structure shown.

What is claimed is:

1. A kite comprising:

a body attached to a rigid frame; and a noise emitting device comprising a resilient bow having a holder at each of its ends and a ribbon attached to each of the bow holders which vibrates in response to air flow; the bow holders comprising a holder member attached to the bow and a saddle which cooperates with the holder member for removably securing the ribbon to the bow; and wherein the holder member comprises a generally U-shaped slotted portion for receiving the saddle.

2. The kite according to claim 1, further comprising indicia formed on the body which simulates an insect.

3. The kite according to claim 1, wherein the saddle comprises a tang at each end for engaging the slotted portion of the holder.

4. A kite comprising:

a body attached to a rigid frame; and a noise emitting device comprising a resilient bow having a holder at each of its ends and a ribbon attached to each of the bow holders which vibrates in response to air flow; the bow holders comprising a holder member attached to the bow and a saddle which cooperates with the holder member for removably securing the ribbon to the bow; and wherein the saddle includes a rounded shaft and a slot formed therein for receiving the ribbon.

5. The kite according to claim 4, wherein the saddle further includes a pair of frustoconical ends which bound the rounded shaft portion.

6. The kite according to claim 1, wherein the noise emitting device further includes a bracket which mounts the bow to the frame.

7. A kite comprising:

a body attached to a rigid frame; and a noise emitting device comprising a resilient bow having a holder at each of its ends and a ribbon attached to each of the bow holders which vibrates in response to air flow; the bow holders comprising a holder member attached to the bow and a saddle which cooperates with the holder member for removably securing the ribbon to the bow; and wherein the noise emitting device further includes a bracket which mounts the bow to the frame and the frame bracket includes a bore which receives the bow and spaces the bow a preselected distance from the body of the kite.

8. The kite according to claim 7, further comprising indicia formed on the body which simulates an insect.

9. The kite according to claim 7, wherein the holder member comprises a slotted portion for receiving the saddle.

10. The kite according to claim 9, wherein the saddle comprises a tang at each end for engaging the slotted portion of the holder.

11. A kite comprising:

a body attached to a rigid frame; and a noise emitting device comprising a resilient bow having a holder at each of its ends and a ribbon attached to each of the bow holders which vibrates in response to air flow; the bow holders comprising a holder member attached to the bow and a saddle which cooperates with the holder member for removably securing the ribbon to the bow; and wherein the holder member comprises a slotted portion for receiving the saddle and the saddle comprises a tang at each end for engaging the slotted portion of the holder and a rounded shaft and a slot formed in the saddle for receiving the ribbon.

12. The kite according to claim 11, wherein the saddle further includes a pair of frustoconical ends which bound the rounded shaft portion.

* * * * *